US010892574B2

(12) United States Patent
Weiss et al.

(10) Patent No.: US 10,892,574 B2
(45) Date of Patent: Jan. 12, 2021

(54) CABLE-TO-BOARD CONNECTOR

(71) Applicant: Paricon Technologies Corporation, Taunton, MA (US)

(72) Inventors: Roger Weiss, Foxboro, MA (US); Everett Simons, Taunton, MA (US); William Petrocelli, Douglas, MA (US); Ethan Berkowitz, Framingham, MA (US)

(73) Assignee: Paricon Technologies Corporation, Taunton, MA (US)

( * ) Notice: Subject to any disclaimer, the term of this patent is extended or adjusted under 35 U.S.C. 154(b) by 0 days.

(21) Appl. No.: 16/348,850

(22) PCT Filed: Oct. 21, 2017

(86) PCT No.: PCT/US2017/057754
§ 371 (c)(1),
(2) Date: May 9, 2019

(87) PCT Pub. No.: WO2018/075986
PCT Pub. Date: Apr. 26, 2018

(65) Prior Publication Data

US 2020/0067215 A1 Feb. 27, 2020

Related U.S. Application Data

(60) Provisional application No. 62/411,009, filed on Oct. 21, 2016.

(51) Int. Cl.
*H01R 12/62* (2011.01)
*H01R 12/59* (2011.01)
*H01R 12/77* (2011.01)

(52) U.S. Cl.
CPC ..... *H01R 12/62* (2013.01); *H01R 12/592* (2013.01)

(58) Field of Classification Search
CPC .. H01R 23/662; H01R 23/668; H01R 13/658; H01R 13/506; H01R 12/68; H01R 12/78; H01R 12/79; H01R 12/592
See application file for complete search history.

(56) References Cited

U.S. PATENT DOCUMENTS 3,629,787 A * 12/1971 Wilson ..... H01R 12/62 439/67
4,130,334 A * 12/1978 Anderson ..... H01R 4/64 439/472

(Continued)

OTHER PUBLICATIONS

The International Search Report and the Written Opinion of the International Searching Authority dated Jan. 4, 2018for PCT Application No. PCT/US2017/057754.

(Continued)

*Primary Examiner* — Edwin A. Leon
*Assistant Examiner* — Milagros Jeancharles
(74) *Attorney, Agent, or Firm* — Brian M. Dingman; Dingman IP Law, PC

(57) ABSTRACT

A cable to board interconnect device that is used to interconnect wires to a printed circuit board (PCB) that has conductive traces on its essentially flat surface, where the wires are essentially parallel to the face of the PCB. The device includes an alignment member that overlies the wires, and an elastomeric conductor between the wires and the PCB traces.

11 Claims, 4 Drawing Sheets

(56) References Cited

U.S. PATENT DOCUMENTS 4,169,641 A * 10/1979 Olsson ..... H01R 12/62 439/493
4,172,626 A * 10/1979 Olsson ..... H01R 12/79 439/329
4,519,659 A * 5/1985 Shiino ..... H01R 13/2414 439/408
4,583,800 A * 4/1986 Roberts ..... H05K 3/365 439/329
4,630,874 A * 12/1986 Renn ..... H01R 12/88 439/263
4,634,195 A * 1/1987 Shoemaker ..... H01R 12/79 439/493
4,695,258 A * 9/1987 Hanson ..... H01R 12/79 439/329
4,718,860 A 1/1988 Gobets et al.
4,768,971 A * 9/1988 Simpson ..... H01R 23/6813 439/329
4,793,814 A 12/1988 Zifcak et al.
4,850,883 A * 7/1989 Kabadi ..... H01R 12/62 439/67
4,913,656 A * 4/1990 Gordon ..... H01R 12/79 439/493
4,993,958 A * 2/1991 Trobough ..... H01R 12/62 439/91
5,161,981 A * 11/1992 Deak ..... H01R 12/62 439/491
5,181,854 A * 1/1993 Masuda ..... H01R 12/62 439/493
5,219,293 A * 6/1993 Imamura ..... H01R 12/62 439/493
5,263,868 A * 11/1993 Renn ..... H01R 12/52 439/67
5,558,523 A * 9/1996 Coteus ..... H01R 12/52 439/493
5,924,875 A * 7/1999 Tighe ..... H01R 12/774 439/66
6,168,442 B1 1/2001 Naoi
6,183,272 B1 * 2/2001 Muller ..... H01R 13/2414 439/66
6,247,951 B1 * 6/2001 Di Liello ..... H01R 12/61 439/329
6,338,653 B1 * 1/2002 Jones ..... H01R 9/0515 439/579
6,342,932 B1 * 1/2002 Terao ..... G02F 1/13452 349/150
6,491,543 B1 * 12/2002 Yatskov ..... H01R 13/2464 439/493
6,602,092 B2 * 8/2003 Soubh ..... H01R 12/62 439/493
6,786,762 B2 * 9/2004 Buck ..... H01R 12/598 439/493
7,033,184 B2 * 4/2006 Cornell ..... H01R 13/2414 439/67
7,223,105 B2 5/2007 Weiss et al.
7,318,745 B1 * 1/2008 Kottke ..... G06F 1/1601 439/493
7,507,100 B2 * 3/2009 Malkin ..... H01R 12/616 439/329
7,594,817 B2 * 9/2009 Wahlberg ..... H01R 12/62 439/492
7,927,110 B1 * 4/2011 Zhu ..... H01R 12/88 439/67
8,144,482 B2 3/2012 Sato et al.
9,041,414 B2 * 5/2015 Nonen ..... G01R 1/0408 324/613
2002/0034892 A1 * 3/2002 Hopfer ..... H01R 12/62 439/493
2005/0079772 A1 * 4/2005 DeLessert ..... G01R 1/06772 439/700
2006/0292900 A1 * 12/2006 Pabst ..... H01R 12/79 439/67
2007/0015375 A1 * 1/2007 Weiss ..... H01R 13/2414 439/66
2007/0026746 A1 * 2/2007 Weiss ..... G01R 1/0735 439/863
2007/0196997 A1 8/2007 Kim et al.
2008/0233793 A1 * 9/2008 Ju ..... H01R 12/79 439/493

OTHER PUBLICATIONS

The International Preliminary Report on Patentability dated May 2, 2019 for PCT Application No. PCT/US2017/057754.

* cited by examiner

CABLE-TO-BOARD CONNECTOR

BACKGROUND

This disclosure relates to an electrical connector.

Flat ribbon style cables are constructed in many formats. Elastomeric connectors can form high performance interconnection between a flex circuit cable (with its conductors that are printed on a flexible substrate) and a printed circuit board (PCB).

In contrast, ribbon cables (with conductors that are discrete wires) typically get soldered directly to the PCB or to an interface board which has a mechanical connector system for connecting to the PCB. Mechanical methods to mount the wire are also used in conjunction with hardware soldered to the PCB. These type of interconnections degrade the electrical performance of the cable to PCB system, use several separate components, and are costly to construct.

SUMMARY

A separable connection between a wire-based cable and a PCB, which has few parts, is easy to install, and due to the controlled geometry of the cable and very thin elastomeric contact maintains the impedance of the cable up to the surface of the PCB. This assures a minimum degradation of the signal with virtually no observed loss due to the connector at frequencies from DC to above 40 GHz.

All examples and features mentioned below can be combined in any technically possible way.

In one aspect, a cable to board interconnect device that is used to interconnect wires of a wire-based cable to a printed circuit board (PCB) that has conductive traces on its essentially flat surface, where the wires are essentially parallel to the face of the PCB, includes an alignment member that overlies the wires, and an elastomeric conductor between the wires and the PCB traces.

Embodiments may include one of the following features, or any combination thereof. The elastomeric conductor may comprise a thin sheet of anisotropic conductive material. The cable to board interconnect device may further include an element to control the deflection of the elastomeric conductor while facilitating a uniform interconnection load between the wires and the PCB. The cable to board interconnect device may further include a window to allow observation of the alignment of the wires to the PCB during assembly. The alignment member may comprise a series of V-grooves that overlay the wires. The device may have an open end on the V-grooves which allows the final alignment of the wires to the PCB traces to be observed. The device may further include a strain relief member that overlies insulated portions of the cable. The alignment member and the strain relief member may both be portions of a unitary part. The unitary part may further comprise an open area between the alignment member and strain relief member. The unitary part may further comprise thin arms alongside the open area, to provide vertical compliance. The device may further include a spring component that is constructed and arranged to provide a spring force that pushes the alignment member against the wires and compresses the elastomeric conductor. The spring component may comprise a leaf spring, or a bar with separate springs.

In another aspect, a cable to board interconnect device that is used to interconnect wires to a printed circuit board (PCB) that has conductive traces on its essentially flat surface, where the wires are essentially parallel to the face of the PCB, includes an alignment member that overlies the wires, wherein the alignment member comprises a series of grooves that overlay the wires, a strain relief member that overlies insulated portions of the cable, wherein the alignment member and the strain relief member are both portions of a unitary part, and a thin sheet of anisotropic conductive material between the wires and the PCB traces.

Embodiments may include one of the above and/or below features, or any combination thereof. The alignment member grooves may be V-grooves. The device may further include an element to control the deflection of the elastomeric conductor while facilitating a uniform interconnection load between the wires and the PCB. The device may further include a window to allow observation of the alignment of the wires to the PCB during assembly. The device may have an open end on the V-grooves which allows the final alignment of the wires to the PCB traces to be observed. The unitary part may further comprise an open area between the alignment member and strain relief member. The unitary part may further comprise thin arms alongside the open area, to provide vertical compliance. The unitary part may be molded from plastic.

BRIEF DESCRIPTION OF THE DRAWINGS

FIG. 1 is a top perspective view of a cable-to-board connector used to electrically couple a multi-conductor electrical cable to the connector of a printed circuit board (PCB), or the like.

DETAILED DESCRIPTION

Figure 1:
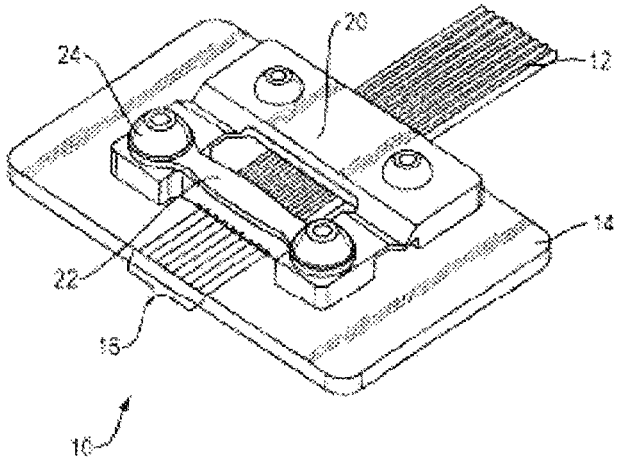

One embodiment of the cable-to-board connector comprises an integrated strain relief and alignment member, a backing plate, a compression load member, screws, and a strip of Anisotropic Conductive Elastomer (ACE). ACE is a compliant material that electrically conducts in one dimension but not the others. A thin sheet of ACE can conduct through its thickness but essentially does not conduct in the other two dimensions. ACE is a well-known material, is described in several patents including U.S. Pat. No. 4,644,101, and is commercially available as PariPoser™ from Paricon Technologies Corp. of Taunton, Mass., USA. FIG. 1 provides a view of the connector assembly mounted on a PCB and FIG. 2 provides an exploded view of the connector assembly.

Figure 2:
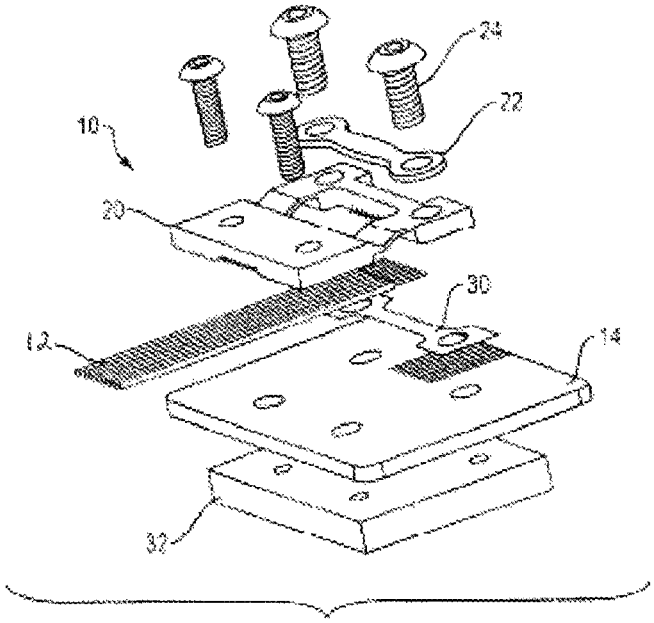
FIG. 2 is an exploded view of the connector of FIG. 1.

Cable-to-board connector 10, FIGS. 1 and 2, is an assembly that is constructed and arranged to electrically couple the conductive wires of ribbon cable 12 to PCB 14, specifically the PCB traces or pads 16. A member 20 serves to both align the cable to the PCB traces and provide strain relief to the cable. Member 20 is shown in detail in FIG. 3. Member 20 is coupled to PCB 14 with four screws 24 that pass through holes (e.g., hole 44) in member 20 and into threaded holes in backing plate 32. Other mechanical means could be used to mount member 20 to PCB 14. ACE portion 30 lies between the exposed wire ends 62 (see FIG. 5) and PCB traces 16, and serves to electrically couple them together. Load clamp 22 is held against member 20 by two of the screws and provides a spring force that helps to push member 20 against the wires and compress ACE 30, so as to provide a number of electrical pathways through the thickness of the ACE.

Figure 3:
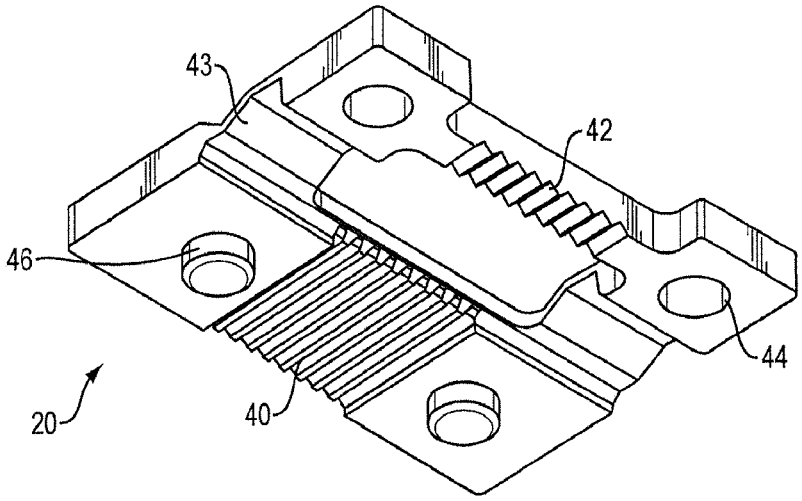
FIG. 3 is an underside view of the integrated strain relief and wire alignment member of the connector of FIG. 1.
Figure 4:
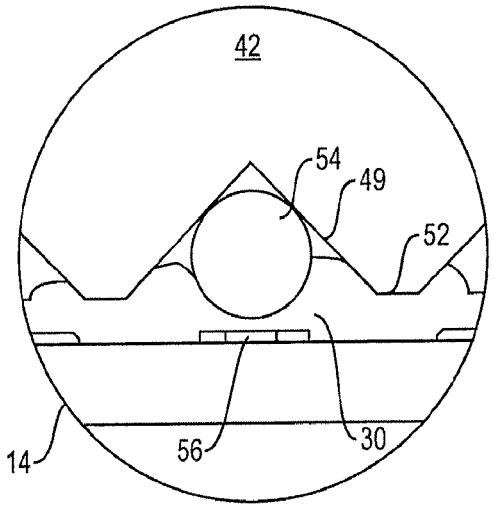
FIG. 4 is an enlarged, schematic, cross-sectional view of a portion of the connector of FIG. 1.

The integrated strain relief and wire alignment member can be (but need not be) a single molded plastic part 20 as shown in FIG. 3. One portion 40 (a strain relief portion or member) of the plastic part 20 is designed, constructed, and arranged to conform to the outer portion of the cable insulation to clamp the insulated portion of the cable between the aligner/strain relief member and the backing plate and thus provide strain relief to the cable. A second portion 42 (a wire alignment portion or member) of part 20 contains an array of grooves (which are in this non-limiting example generally V-shaped as shown in FIG. 4), which are constructed and arranged to directly overlie each of the exposed wires at the end of the cable, and constrain the wires to be in proper alignment with the traces/pads formed on the PCB. Four holes 44 are provided. Two of these are part of the strain relief and are used to load the strain relief member to threaded holes in the rear of the backing plate. These holes have alignment bosses 46 which fit into holes in the PCB assuring the connector is well aligned to the PCB. All four of the holes can have alignment bosses, which may accomplish better alignment. Two of the holes are in line with the array of wires at the front of the connector. These are used to mount a clamping member (the load clamp 22) across the array of wires forcing the wires into intimate contact with the PCB traces through the elastomeric conductive member. The clamping member may be designed to achieve desired objectives. Two non-limiting examples include a solid bar with spring washers (or other types of small springs) under each of the two screws, or a formed spring (e.g., a leaf spring) to provide uniform load across the array of wires as shown in FIG. 2.

The molded plastic member (which may be made from materials other than plastic) may also contain a window (an opening) 45 allowing the cable to be inspected during assembly. The window is not necessary to the functions of the wire to board contact or cable strain relief, so is not required. The window, coupled with a thinned area in the arms 43 connecting the strain relief to the wire control structure allows the wire control to be rigid in the plane of the PCB and flexible to move perpendicular to the board. This helps to assure that the load applied to the wires is not significantly impacted by the stiffness of the plastic member.

There can be a flat area 52 between each wire control "v" groove 49 in portion 42 of the compression load member. This is designed to control the compression of the elastomeric strip as well as maintaining the pressure of the wire 54—elastomer 30—PCB trace 56 interface. In practice, the flat area pinches the elastomer to the surface of the board and pushes or extrudes the elastomer into the wire-containing groove 49. At the same time, the elastomer under the wire is extruded outward causing the ACE to flow around the wire into the space between the wire and groove wall, as is shown in FIG. 4. This helps to provide a greater contact area of the ACE to the wire, which helps achieve a stable interconnection between the board and the wire.

This embodiment uses an Anisotropic Conducting Elastomer (ACE) which only conducts perpendicular to its surface, resulting in high insulation resistance between wires. When using the same hardware but excluding the ACE (i.e., direct wire to PCB trace contact), the quality of the contact is poor and open circuits are common. Measured data showed that open contacts occurred for a significant number of the wires in the cable. For example, in one test the same 40 wire ribbon cable was connected to a PCB with and without the ACE (using the same cable-to-board connector shown in FIGS. 1-5, in one case with the ACE and the other case without the ACE). The resistance of each wire to board connection was measured. When the ACE was used, the resistance in all 40 connections was less than 100 milliohms. Without the ACE, only 5 connections had a resistance of less than 100 milliohms, while 27 connections (about ⅔ of the connections) were open circuits (i.e., greater than 50 ohms resistance).

Connector Assembly

Figure 5:
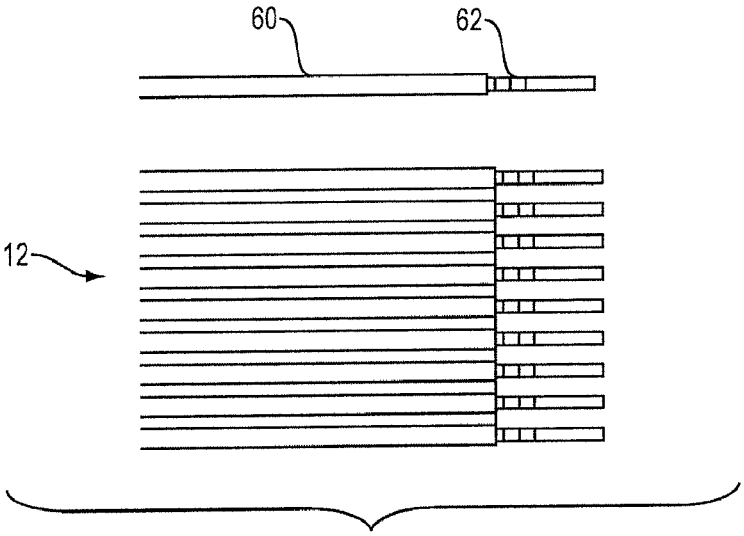
FIG. 5 is a top, partially separated view of the ribbon cable from FIG. 1.

The cable insulation is stripped and the wires are optionally formed similar to those shown in FIG. 5, where cable 12 has a number of wires with insulated portion 60 and stripped end portion 62. The purpose of forming the wires is to bend the plane of the stripped wires below the plane of the insulated wire so that the bare wire can remain short and the insulated wire will not impede the stripped wire from making contact with the PCB.

The strip of ACE is placed over the contact zone of the pads. The plastic member is fit to the cable and the strain relief loosely mounted to the backing plate. The cable is slid forward until the insulation contacts the window side of the wire grooves thus setting the axial position of the cable to the board. The wires will typically protrude past the alignment member and over the exposed PCB traces. This will allow visualization of proper wire/trace alignment. If necessary, the plane of the wires can be rotated such that the wires are over the PCB contact pads (e.g., the PCB traces) with the ACE between the pads and the wires. The spring member is placed on top of the plastic between the two front screw holes. The front screws are tightened into threaded holes in the backing plate providing a uniform compressive load to the array of wires. The rear screws are fully tightened to provide a quality strain relief. The wires are easily visualized through the window, allowing the opportunity to check that the wires are in proper alignment with the board traces.

Additional Options

Figure 6:
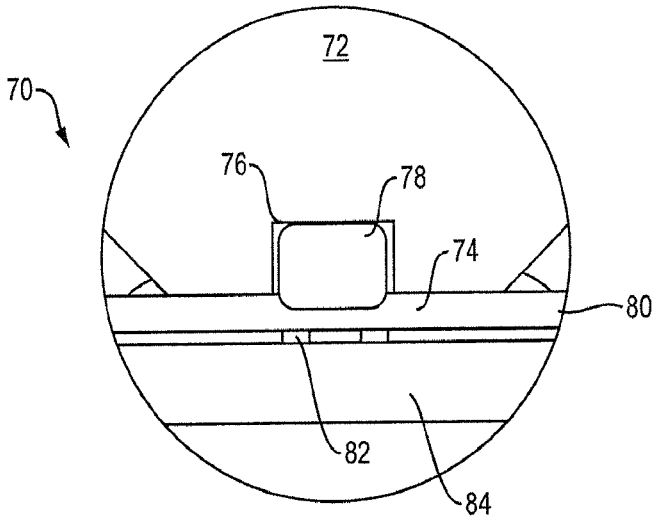
FIG. 6 is a view similar to that if FIG. 4, but for a different electrical cable wire shape.
Figure 7:
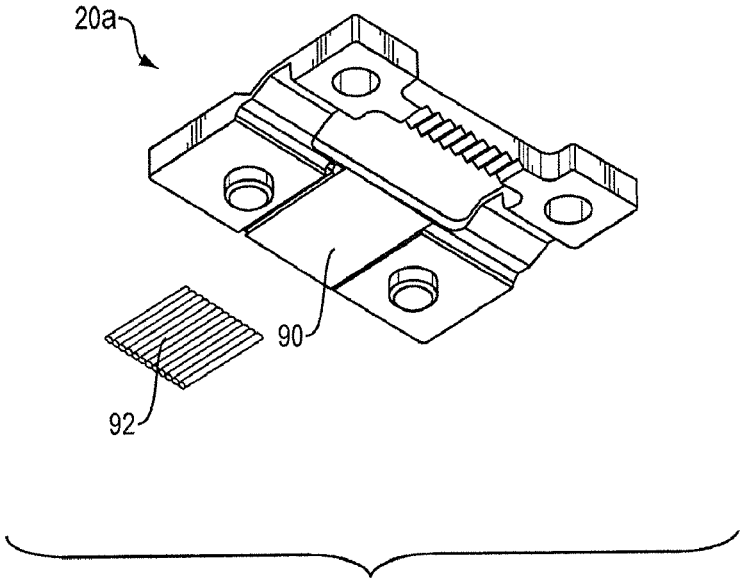
FIG. 7 is an underside view of an alternative strain relief and wire alignment member.

1. The interconnecting load may be applied using a rigid member (as opposed to the load clamp described above) with springs (e.g., Belleville washers) between the mounting screw heads and the rigid member.
2. Interconnection of wires whose cross section is not circular using a groove that is optimized for the shape of the wire (which would typically mean that the shape was at least generally complementary to the shape of the wire). FIG. 6 shows a connector 70 for a rectangular wire 78 and a rectangular groove 76 in aligner portion 72 of member 20, with flats 74 that press against ACE 80 that overlays PCB 84 contact 82. This is but one of many possible shapes and configurations.
3. The strain relief can be a separate piece part that snaps or otherwise fits into a universal groove/receptacle/slot in the plastic body. FIG. 7 provides an illustration of this option where member **20*a* has slot 90 that removably holds strain relief member 92** which has an array of grooves to match a specific cable.
4. A rubber (compliant) sheet can be mounted in the strain relief slot 90, rather than a pre-formed strain relief member 92. A compliant sheet can press down on virtually any cable configuration, and so can be used to accept cables over a wide range of shapes.
5. The ends of the wires can be flattened, e.g., by coining them to a controlled dimension. This provides a greater contact area of the wires to the aligner and the ACE, which may help to ensure a good electrical connection.

6. The strain relief and wire alignment members can be separate parts that are each coupled to the PCB.

A number of implementations have been described. Nevertheless, it will be understood that additional modifications may be made without departing from the scope of the inventive concepts described herein, and, accordingly, other embodiments are within the scope of the following claims.

What is claimed is:

1. A cable to board interconnect device that is used to interconnect exposed wires of a wire-based cable to a printed circuit board (PCB) that has conductive traces on its essentially flat surface, where the exposed wires are essentially parallel to the face of the PCB, the device comprising:

an integrated strain relief and wire alignment member comprising: a strain relief portion that is constructed and arranged to conform to an outer portion of the cable, to clamp the cable between the strain relief portion and the PCB and thus provide strain relief to the cable; a wire alignment portion that defines an array of grooves that are constructed and arranged to directly overlie each of the exposed wires at an end of the cable, and constrain the exposed wires to be in proper alignment with conductors on the PCB; and a connecting portion that is thinner than both the strain relief portion and the wire alignment portion, wherein the connecting portion is angled with respect to both the strain relief portion and the wire alignment portion, to maintain a bottom of wire alignment portion at a higher plane than a bottom of the strain relief portion, so that the wire alignment portion can move down relative to the strain relief portion; and an elastomeric conductor between the exposed wires and the PCB conductors.

2. The cable to board interconnect device of claim 1, wherein the elastomeric conductor comprises a thin sheet of anisotropic conductive material.

3. The cable to board interconnect device of claim 1, further comprising an element to control the deflection of the elastomeric conductor while facilitating a uniform interconnection load between the exposed wires and the PCB.

4. The cable to board interconnect device of claim 1, wherein the integrated strain relief and wire alignment member further comprises a window in the connecting portion, to allow observation of the alignment of the wires to the PCB during assembly.

5. The cable to board interconnect device of claim 4, wherein the connecting portion defines thin arms alongside the window area, to provide vertical compliance.

6. The cable to board interconnect device of claim 1, wherein the wire alignment portion comprises a series of spaced V-grooves that overlay the wires.

7. The cable to board interconnect device of claim 6, wherein the wire alignment portion has an open end on the V-grooves which allows the final alignment of the wires to the PCB to be observed.

8. The cable to board interconnect device of claim 7, wherein the wire alignment portion further comprises a flat area between each of the V-grooves.

9. The cable to board interconnect device of claim 1, further comprising a spring component that is constructed and arranged to provide a spring force that pushes the integrated strain relief and wire alignment member align against the wires and compresses the elastomeric conductor.

10. The cable to board interconnect device of claim 9, wherein the spring component comprises a leaf spring or a bar with separate springs.

11. The cable to board interconnect device of claim 1, wherein the integrated strain relief and wire alignment member unit is molded from plastic.

* * * * *